US009243419B2

(12) United States Patent
Niidome et al.

(10) Patent No.: US 9,243,419 B2
(45) Date of Patent: Jan. 26, 2016

(54) SUPPORT WIRE IMPLANTING ANCHOR

(71) Applicants: TOKYO ELECTRIC POWER COMPANY, INCORPORATED, Tokyo (JP); IWABUCHI CORPORATION, Matsudo, Chiba-Pref. (JP)

(72) Inventors: Yuya Niidome, Tokyo (JP); Mitsuhiro Kuwabara, Chiba-Pref. (JP)

(73) Assignees: Tokyo Electric Power Company, Incorporated, Tokyo (JP); Iwabuchi Corporation, Matsudo (JP)

( * ) Notice: Subject to any disclaimer, the term of this patent is extended or adjusted under 35 U.S.C. 154(b) by 0 days.

(21) Appl. No.: 14/566,477

(22) Filed: Dec. 10, 2014

(65) Prior Publication Data

US 2015/0322689 A1 Nov. 12, 2015

(30) Foreign Application Priority Data

May 12, 2014 (JP) ..... 2014-98578

(51) Int. Cl.
*A47B 97/00* (2006.01)
*E04H 12/22* (2006.01)

(52) U.S. Cl.
CPC ..... *E04H 12/22* (2013.01)

(58) Field of Classification Search
USPC ..... 248/544, 545, 530, 532, 156, 507, 508, 248/500, 506; 135/118; 52/155
See application file for complete search history.

(56) References Cited

U.S. PATENT DOCUMENTS

| | | | | | |
|---|---|---|---|---|---|
| 1,235,417 | A * | 7/1917 | Basnet | 135/118 | |
| 1,775,317 | A * | 9/1930 | Milliken | 52/155 | |
| 2,784,815 | A * | 3/1957 | Larson | 52/155 | |
| 3,139,163 | A * | 6/1964 | Haller | 52/155 | |
| 4,063,567 | A * | 12/1977 | Martin et al. | 135/118 | |
| 5,058,337 | A * | 10/1991 | O'Connor | 52/162 | |
| 5,104,074 | A * | 4/1992 | Malloy | 248/156 | |
| 5,175,966 | A * | 1/1993 | Remke | E02D 5/80 | 405/244 |
| 5,775,037 | A * | 7/1998 | James | 52/163 | |
| 5,881,506 | A * | 3/1999 | Chapman et al. | 52/166 | |
| 6,237,289 | B1 * | 5/2001 | Jewett et al. | 52/163 | |
| 6,301,830 | B1 * | 10/2001 | Whipple | 47/43 | |
| 6,941,885 | B2 * | 9/2005 | Zimmerman et al. | 114/294 | |
| 7,713,003 | B2 * | 5/2010 | Agg | 405/259.1 | |
| 8,118,047 | B2 * | 2/2012 | Simonson et al. | 135/118 | |
| 8,157,482 | B2 * | 4/2012 | Carpenter et al. | 405/259.1 | |
| 2005/0016574 | A1 * | 1/2005 | Holub | 135/118 | |
| 2010/0001242 | A1 * | 1/2010 | Moffat | E02D 5/80 | 254/252 |

FOREIGN PATENT DOCUMENTS

JP 7-30746 7/1995

* cited by examiner

*Primary Examiner* — Terrell McKinnon
*Assistant Examiner* — Michael McDuffie
(74) *Attorney, Agent, or Firm* — Rodman & Rodman LLP

(57) ABSTRACT

A rod portion is coupled to a support wire at one end thereof and is rotatably coupled to a base portion of the anchor body portion. The anchor body portion includes the resistance plate body, an inner reinforcing plate, and an outer reinforcing plate, a first hitting portion is provided on the outer reinforcing plate, and a second hitting portion to be hit next to the first hitting portion is provided at a position higher than the first hitting portion.

6 Claims, 10 Drawing Sheets

SUPPORT WIRE IMPLANTING ANCHOR

BACKGROUND OF THE INVENTION

1. Field of the Invention

The present invention relates to a support wire implanting anchor configured to be implanted by an implanting tool in the case of coupling an aboveground upright member and the ground with a support wire and embedded under the soil in order to prevent the aboveground upright member such as a power pole from falling down, for example.

2. Description of the Related Art

In order to prevent an aboveground upright member such as a power pole from falling down, there is proposed a support wire implanting anchor configured to be implanted by an implanting tool and embedded under the soil in the case of coupling the aboveground upright member and the ground by a support wire, for example, a configuration in which a curved resistance plate body and a curved stabilizing plate are hammered in separately after a test drill of an embedding hole, and the resistance plate body and the stabilizing plate are coupled in an intersecting manner at a predetermined depth under the soil to obtain a tension-resistance force (For example, Japanese Examined Utility Model Application Publication No. Hei 7-30746).

However, in the support wire implanting anchor of the related art described in Japanese Examined Utility Model Application Publication No. Hei 7-30746, the resistance plate is curved so as to obtain a sufficient resistance force (tension-resistance force) when being implanted into the soil, and goes into the soil along the curved shape.

Therefore, in particular, when executing this operation in a little space in the case where a cutting surface area of the embedding hole is small, an implanting work on a single implanting surface (hitting surface) becomes gradually difficult, and the resistance plate body cannot be implanted at an acute angle with respect to the ground surface. Therefore, the sufficient resistance force cannot be obtained unless the resistance plate body and the stabilizing plate are coupled in a deployed state.

If a curvature of the resistance plate is increased in order to bring the sufficient resistance force into action, the resistance plate curves into the soil at the large curvature and hence goes into the soil at an acute angle with respect to the ground surface. Therefore, if there is only one hitting surface and the cutting surface area is small, this problem becomes remarkable.

Since the support wire implanting anchor of the related art described in JP-UM-B-7-30746 needs to hammer the curved resistance plate body and the curved stabilizing plate separately, there is a problem of poor workability.

In view of such a problem, it is a first object of the invention to provide a support wire implanting anchor in which an anchor body portion can be implanted at an acute angle with respect to a ground surface more easily and reliably than those of the related art even though a cutting surface area of an embedding hole is small and, in addition, a second object of the invention to provide the support wire implanting anchor with achieves an improvement of workability and higher tension-resistance force without necessity of implanting of a stabilizing plate separately from a resistance plate.

SUMMARY

In order to solve the above-described problem, a support wire implanting anchor according to the embodiment of the invention relates to a support wire implanting anchor configured to be implanted by an implanting tool in the case of coupling an aboveground upright member and the ground with a support wire and embedded under the soil in order to prevent the aboveground upright member such as a power pole from falling down, comprising: a rod portion; and an anchor body portion, wherein the rod portion includes an upper coupling portion coupled to the support wire, and a lower coupling portion coupled to the anchor body portion, the anchor body portion includes a resistance plate body curved so as to protrude toward the outside, an inner reinforcing plate provided so as to extend upright from an inner side of the resistance plate body and supported rotatably at the other end portion of the rod portion, and an outer reinforcing plate provided so as to extend upright from an outside of the resistance plate body, a first hitting portion hit by the implanting tool firstly is provided on the outer reinforcing plate, and a second hitting portion hit next to the first hitting portion is provided at a position higher than the first hitting portion.

Here, the second hitting portion is preferably provided on an upper end portion of the inner reinforcing plate.

Preferably, the anchor body portion includes a movable resisting plate configured to be in a closed state in proximity to the anchor body portion when being implanted into the soil, and opened by a resistance applied from earth and sand in the soil in the case of being embedded under the soil and pulled in a direction pulled out from under the soil.

Preferably, the outer reinforcing plate of the anchor body portion is provided with a fan-shaped opening portion having a center at a joint portion between an outer surface of the resistance plate body and the outer reinforcing plate and having a fan shape with an arc on an upper side, and the movable resisting plate is provided with a slit at the center thereof, is movably fitted to the fan-shaped opening portion with the slit loosely fitting on the outer reinforcing plate when being mounted in the fan-shaped opening portion, and is configured to close in proximity to the anchor body portion when being implanted into the soil, and open by a resistance applied from earth and sand in the soil when being embedded and pulled in a direction pulled out from under the soil.

According to the support wire implanting anchor of the invention, the anchor body portion includes the resistance plate body, and the inner reinforcing plate provided so as to extend upright from an inner side of the resistance plate body and supported rotatably at the other end portion of the rod portion, and the outer reinforcing plate provided so as to extend upright from an outside of the resistance plate body, the first hitting portion hit by an implanting tool firstly is provided on the outer reinforcing plate, and the second hitting portion hit next to the first hitting portion is provided at a position higher than the first hitting portion. Even though the cutting surface area of the embedding hole is small, or the curvature of the anchor body portion is large, the anchor body portion can be implanted at an acute angle into the ground surface simply and reliably in comparison with those of the related art.

In addition, with the provision of the movable resisting plate configured to close in proximity to the anchor body portion when being implanted into the soil, and open by being embedded in the soil and applied with the resistance from earth and sand in the soil in the direction pulled out from under the soil, implanting of the stabilizing plate separately from the resistance plate is not necessary, and hence a higher tension-resistance force is achieved while improving the workability.

DESCRIPTION OF THE PREFERRED EMBODIMENTS

A support wire implanting anchor 1 of an embodiment of the invention will be described with reference to the drawings.

Configuration of Support Wire Implanting Anchor

Figure 1:
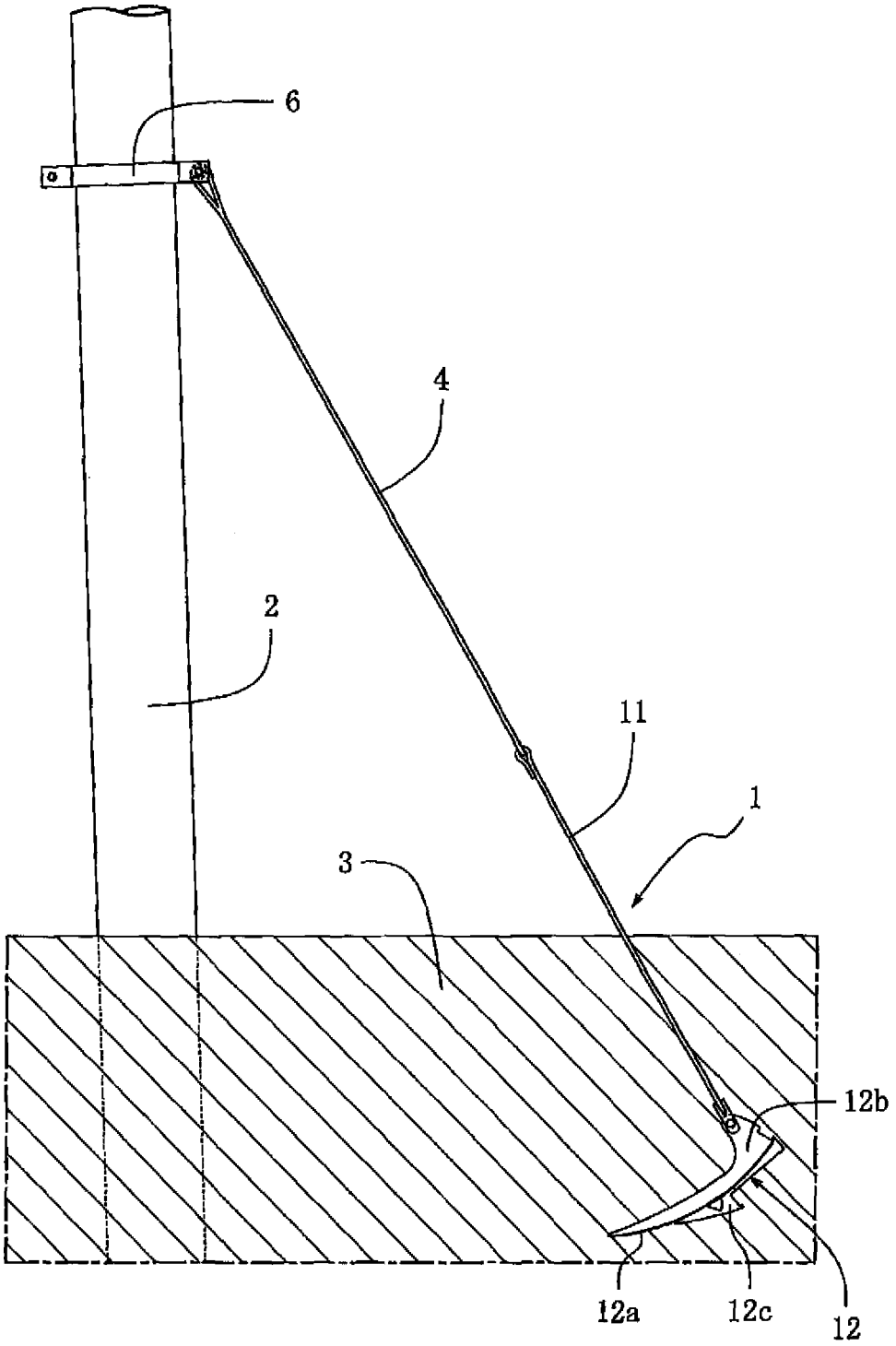
FIG. 1 is a front view illustrating a state of usage of a support wire implanting anchor of the invention.
Figure 2:
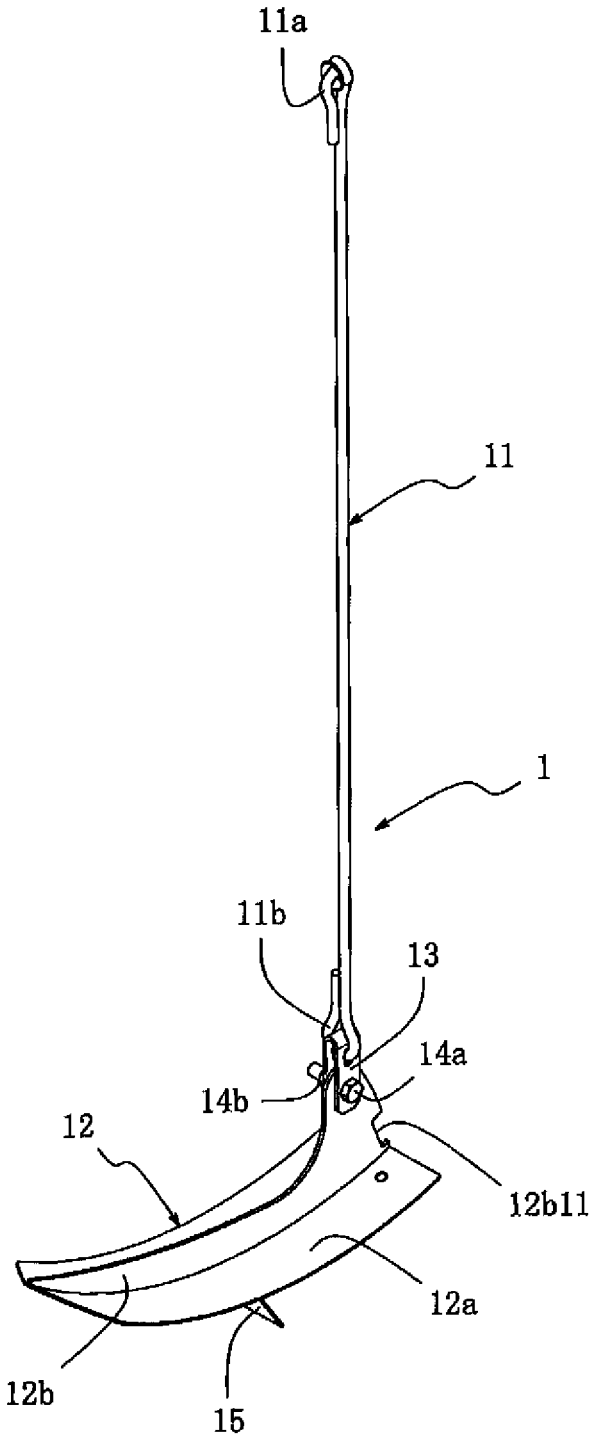
FIG. 2 is a perspective view of the support wire implanting anchor of the invention viewed from obliquely forward and upward.
Figure 3:
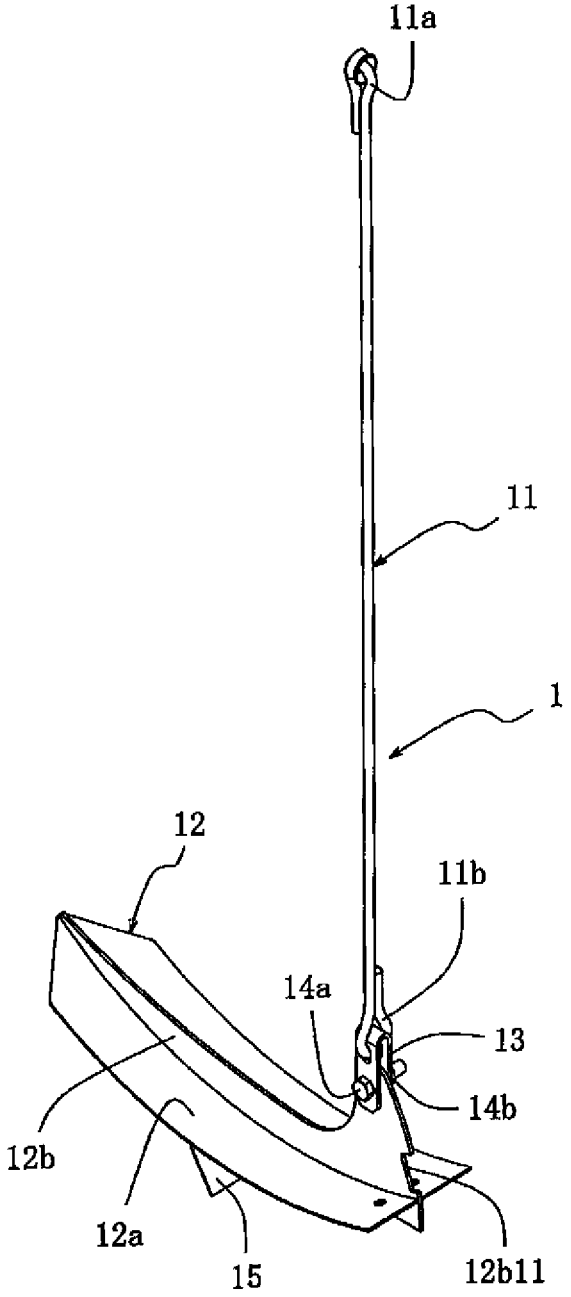
FIG. 3 is a perspective view of the support wire implanting anchor of the embodiment of the invention viewed from obliquely rearward and upward.
Figure 4:
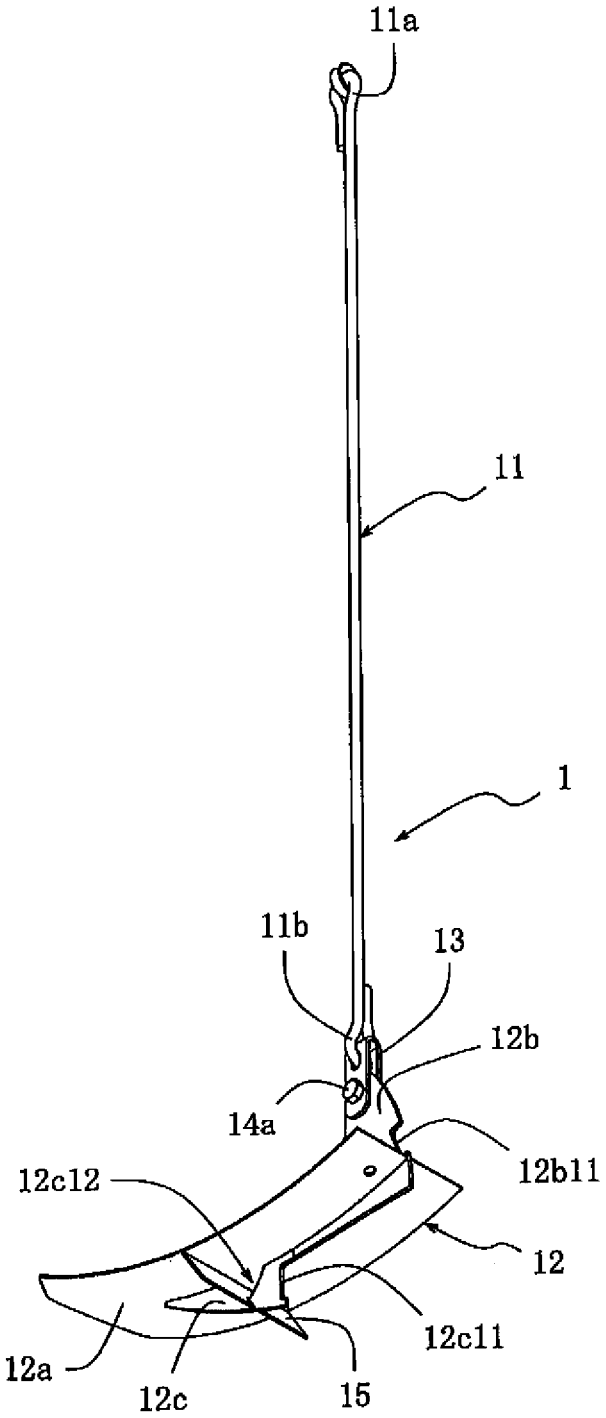
FIG. 4 is a perspective view of the support wire implanting anchor of the embodiment of the invention viewed from obliquely rearward and downward.

The support wire implanting anchor 1 is configured to be embedded under the soil by being implanted using an implanting tool 5 (see FIG. 5) when coupling an aboveground upright member (aboveground established member) 2 such as a power pole illustrated in FIG. 1 and a ground 3 with a support wire 4 in order to prevent the aboveground upright member 2 from falling down, and includes a rod portion 11, an anchor body portion 12, a U-shaped relay plate portion 13 configured to relay coupling between the rod portion 11 and the anchor body portion 12, a bolt 14*a* and a nut 14*b*, and a movable resisting plate 15 as illustrated in FIG. 2 to FIG. 5.

The rod portion 11 is coupled to the support wire 4 at one end portion thereof, and is rotatably coupled with a base portion of the anchor body portion 12 at the other end portion thereof. Therefore, when the one end portion (upper end portion) of the rod portion 11 is folded back to form an upper coupling portion 11*a*, while the other end portion (lower end portion) of the rod portion 11 is folded back to form a lower coupling portion 11*b* to which the U-shaped relay plate portion 13 is coupled.

The anchor body portion 12 includes a resistance plate body 12*a*, which forms a surface substantially vertical to a longitudinal direction of the rod portion 11, an inner reinforcing plate 12*b* provided inside the resistance plate body 12*a*, and configured to rotatably support the rod portion 11 via the U-shaped relay plate portion 13 and form a surface substantially parallel to the longitudinal direction of the rod portion 11, and an outer reinforcing plate 12*c* provided on an outside of the resistance plate body 12*a* and forms a surface substantially parallel to the longitudinal direction of the rod portion 11.

The resistance plate body 12*a* is rotatably coupled to the rod portion 11 so as to be rotatable in a circumferential direction along a circle having a radius corresponding to the rod portion 11 via the U-shaped relay plate 13 with respect to the rod portion 11.

The resistance plate body 12*a* is a portion most likely receiving the resistance of the support wire 4 when being implanted and embedded under the ground 3, and hence has a surface substantially vertical to the longitudinal direction of the rod portion 11. The surface curves so as to protrude so as to be convex outward along a circumferential direction of a circle having a radius corresponding substantially to the rod portion 11 so as to go into the ground 3 in an oblique direction in a direction substantially perpendicular to the longitudinal direction of the rod portion 11.

The inner reinforcing plate 12*b* is longer than the outer reinforcing plate 12*c*, and is formed to have a length extending substantially from a distal end portion to the upper end portion of the resistance plate body 12*a*, and is joined to the resistance plate body 12*a* perpendicularly thereto by welding or the like.

The inner reinforcing plate 12*b* has an acute angle at the distal end thereof and is increased in width as it goes toward the upper end portion, and includes a base portion 12*b*1 to which the U-shaped relay plate portion 13 is coupled via the bolt 14*a* and the nut 14*b*. The base portion 12*b*1 is provided with a second hitting portion 12*b*11 to be hit by the implanting tool 5.

Figure 5A:
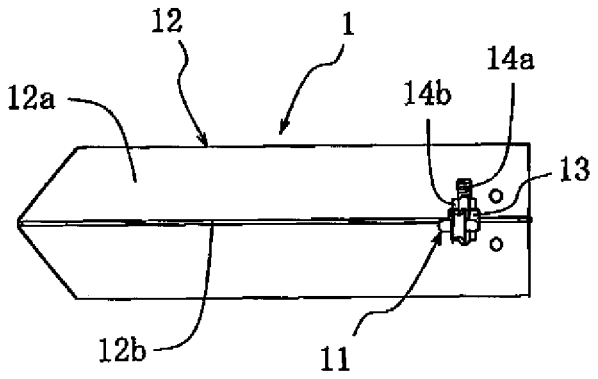
FIGS. 5A to 5D are a plan view, a front view, and a right view of the support wire implanting anchor and a plan view of a movable resisting plate of the embodiment of the invention, respectively.
Figure 5D:
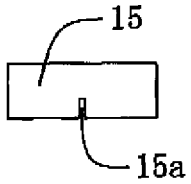
Figure 5B:
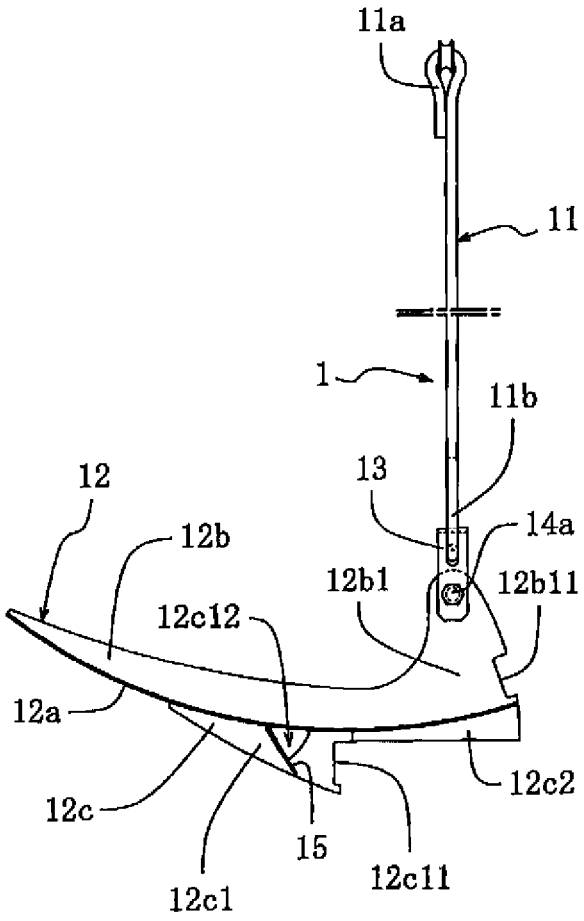
Figure 5C:
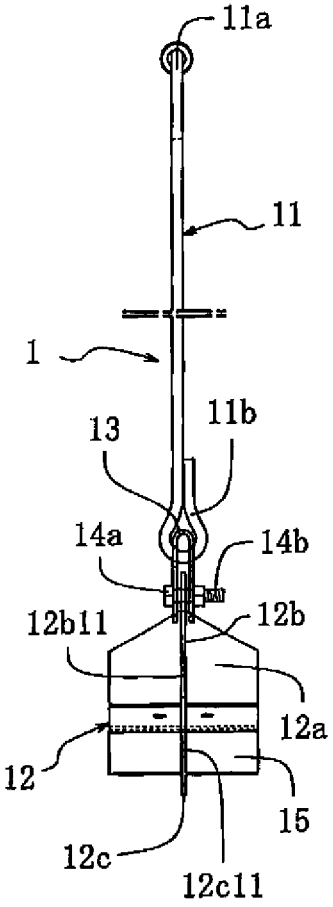

The outer reinforcing plate 12*c* is provided on a side surface on the outside of the resistance plate body 12*a*, that is, on a surface opposite to the inner reinforcing plate 12*b* and, as illustrated in FIG. 5B. etc, is formed into a two-step saw-blade shape (waveform or notched shape) including a first outer reinforcing plate portion 12*c*1 on a distal side of the resistance plate body 12*a* and a second outer reinforcing plate portion 12*c*2 on a rear end side thereof, and is provided with a first hitting portion 12*c*11 to be hit by the implanting tool 5 at an upper end portion of the first outer reinforcing plate portion 12*c*1 on the distal end side.

Therefore, the first hitting portion 12*c*11 provided on the outer reinforcing plate 12*c* is provided at a position closer to the distal end side of the resistance plate body 12*a* than the second hitting portion 12*b*11 provided on the inner reinforcing plate 12*b*.

Here, the first hitting portion 12*c*11 and the second hitting portion 12*b*11 are notched into a depressed shape so as to ensure fitting of plus-shaped grooves or a minus-shaped groove formed at the distal end portion of the implanting tool 5 and so as not to come off (so as not to be displaced) at the time of hitting. In this invention, however, the first hitting portion 12*c*11 and the second hitting portion 12*b*11 do not need to be notched into a depressed shape, and may be modified as needed such as a linear shape, or a linear shape provided with a stopper, or welding of the reinforcing plate. What is essential is that the second hitting portion is provided at a position higher than the position of the first hitting portion 12*c*11 provided on the outer reinforcing plate 12*c*.

The first outer reinforcing plate portion 12*c*1 of the outer reinforcing plate 12*c* is provided with a fan-shaped opening portion 12*c*12 formed with a fan shape having a center at a joint point between an outer surface of the resistance plate body 12*a* and the outer reinforcing plate 12*c* and an arc side on the upper side (upper end portion), and the movable resisting plate 15 is provided on the fan-shaped opening portion 12*c*12. As described later, the fan-shaped opening portion 12*c*12 and the movable resisting plate 15 are not essential to the invention, and may be omitted.

The movable resisting plate 15 is provided with a slit 15*a* at a center thereof as illustrated in FIG. 5D, and the slit 15*a* is movably fitted to fitted to the fan-shaped opening portion 12*c*12 by being loosely fitted to the first outer reinforcing plate portion 12*c*1 of the outer reinforcing plate 12*c* when being mounted on the fan-shaped opening portion 12*c*12.

Therefore, the movable resisting plate 15 closes in proximity to the anchor body portion 12 at the time of implanting into the soil, and is opened by a resistance applied from earth and sand in the ground 3 when being embedded into the ground 3 and pulled in a direction pulled out from under the ground 3.

Method of Usage of Support Wire Implanting Anchor

Subsequently, a method of usage of the support wire implanting anchor 1 of the embodiment configured as described above will be described.

Figure 6:
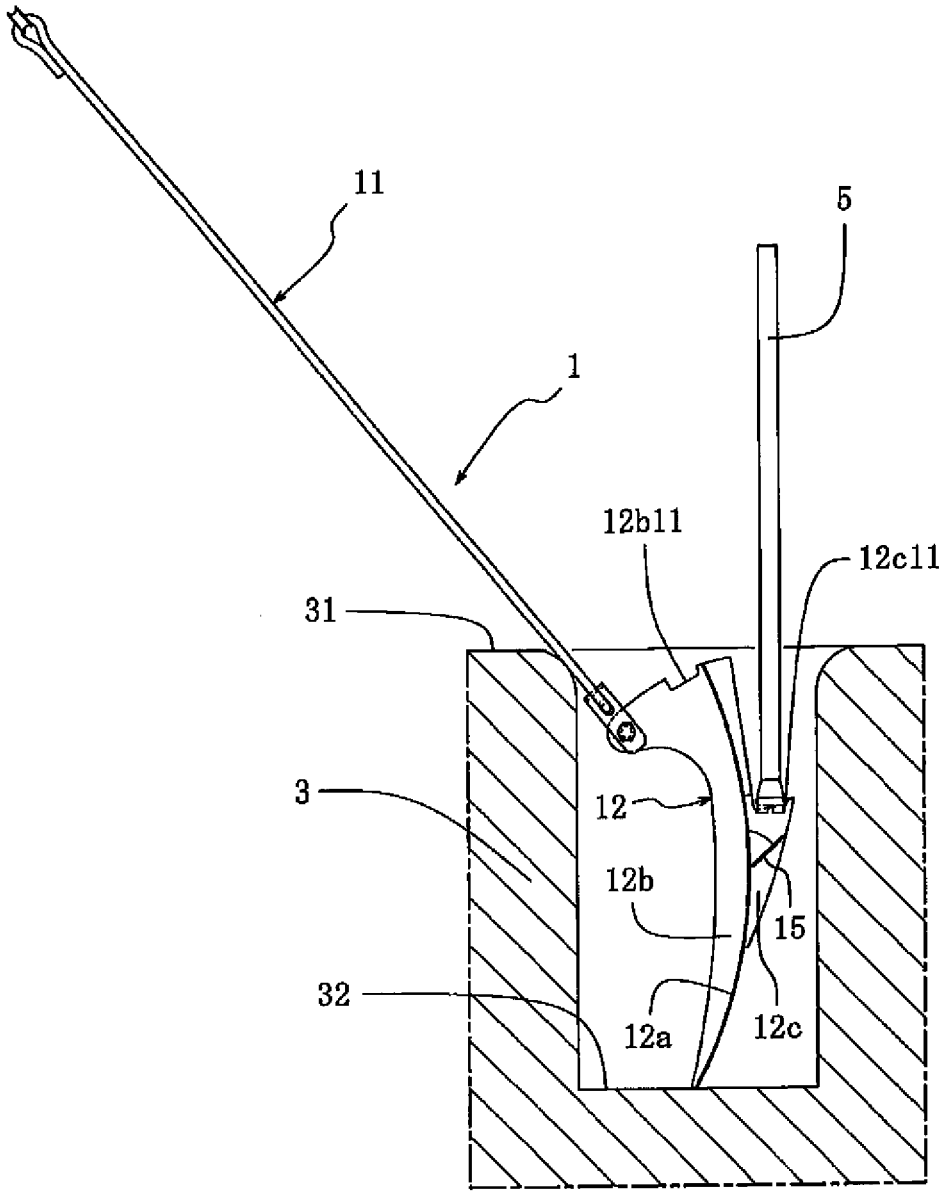
FIG. 6 is an explanatory drawing illustrating a first stage (a stage of being inserted into an embedding hole) of a method of usage of the support wire implanting anchor according to the embodiment of the invention.

First of all, as illustrated in FIG. 6, in order to embed the support wire implanting anchor 1, an embedding hole 32 for accommodating the anchor body portion 12 of the support wire implanting anchor 1 is formed in the ground 3, and then, the anchor body portion 12 of the support wire implanting anchor 1 is inserted into the embedding hole 32.

Subsequently, as illustrated in FIG. 6, the distal end portion of the implanting tool 5 is aligned with the first hitting portion 12*c*11 provided on the outer reinforcing plate 12*c* of the anchor body portion 12, the first hitting portion 12*c*11 is hit by the implanting tool 5, and the anchor body portion 12 is implanted into the ground 3 to about a half.

Figure 7:
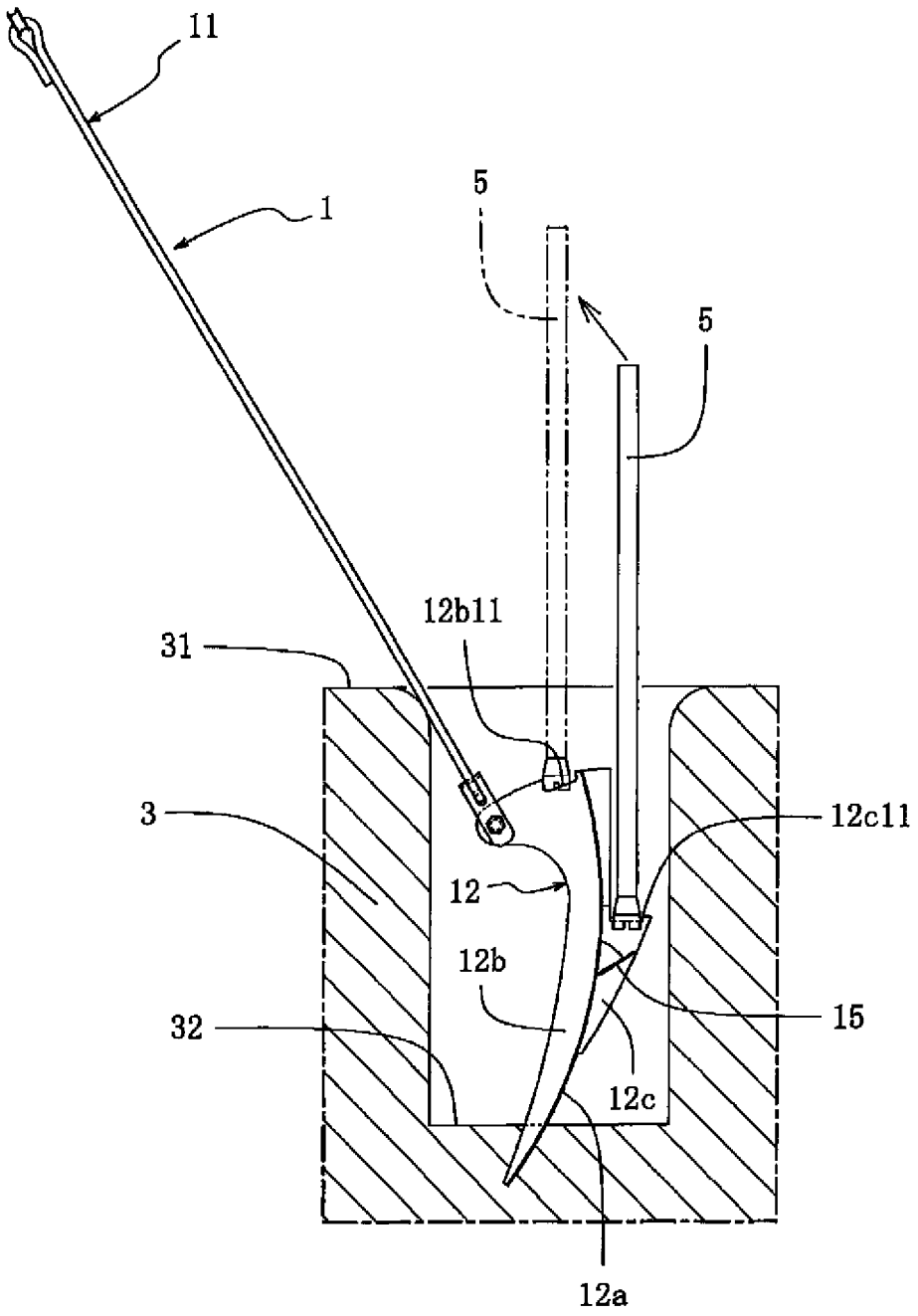
FIG. 7 is an explanatory drawing illustrating a second stage (a stage of being implanted into the soil by hitting a first hitting portion) of a method of usage of the support wire implanting anchor according to the embodiment of the invention.

The anchor body portion 12 is curved so that the outside protrudes, and hence goes into a ground surface 31 from the distal end thereof in a slanted state as illustrated in FIG. 7.

Therefore, the first hitting portion 12*c*11 provided at an upper end portion of the first outer reinforcing plate portion 12*c*1 of the outer reinforcing plate 12*c* goes in an oblique direction, not in the perpendicular direction as well and moves to a position closer to the rod portion 11 than the upper end portion of the resistance plate body 12*a*.

In a state in which the anchor body portion 12 of the support wire implanting anchor 1 is implanted into the ground 3 to about a half as illustrated in FIG. 7, the implanting tool 5 abuts against the resistance plate body 12*a* of the anchor body portion 12, and hence hitting of the first hitting portion 12*c*11 by the distal end portion of the implanting tool 5 is difficult.

Figure 8:
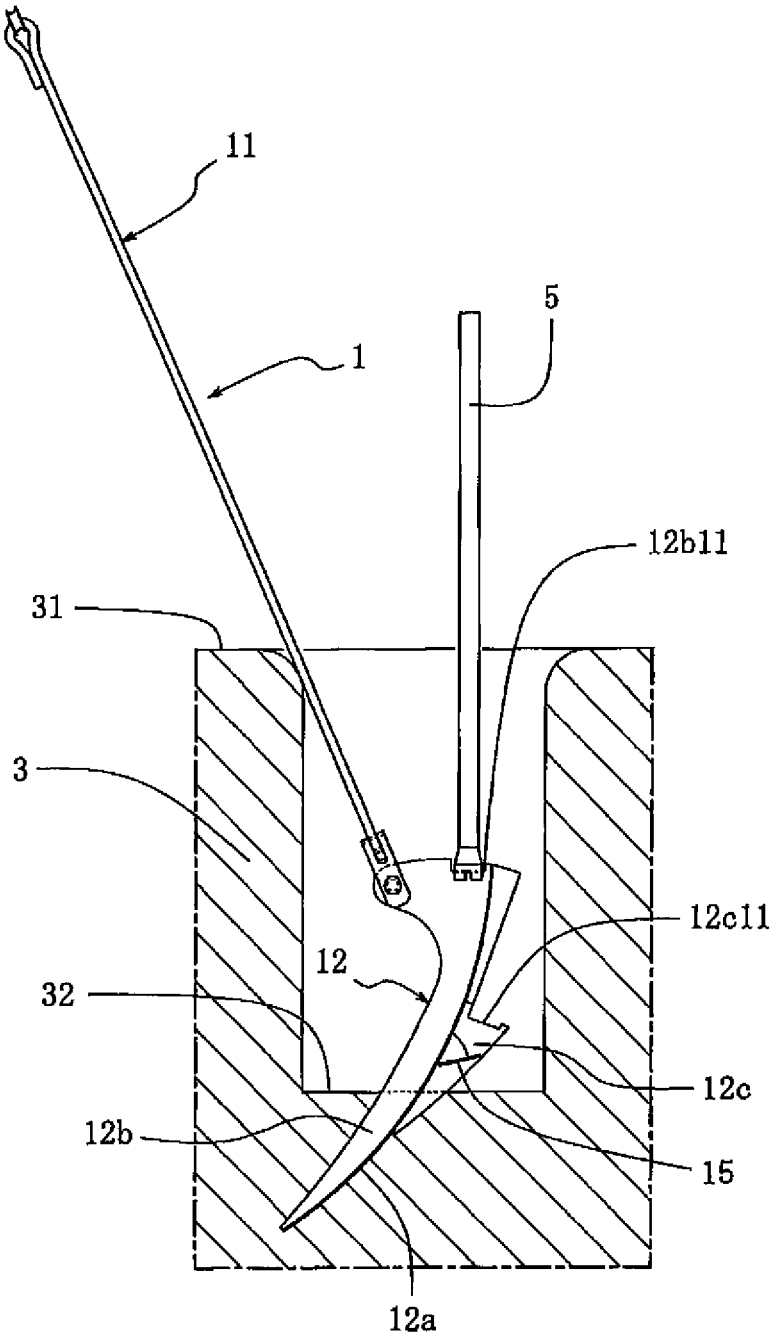
FIG. 8 is an explanatory drawing illustrating a third stage (a stage of being implanted into the soil by hitting a second hitting portion) of a method of usage of the support wire implanting anchor according to the embodiment of the invention.

Therefore, an operator moves the distal end of the implanting tool 5 away from the first hitting portion 12*c*11 as illustrated by a solid line in FIG. 7, continues to hit by bringing the distal end portion of the implanting tool 5 into abutment with the second hitting portion 12*b*11 provided on an upper end portion of the inner reinforcing plate 12*b* (upper end portion) which is a position higher than the first hitting portion 12*c*11 illustrated by a double-dashed chain line in FIG. 7 and as illustrated in FIG. 8.

Figure 9:
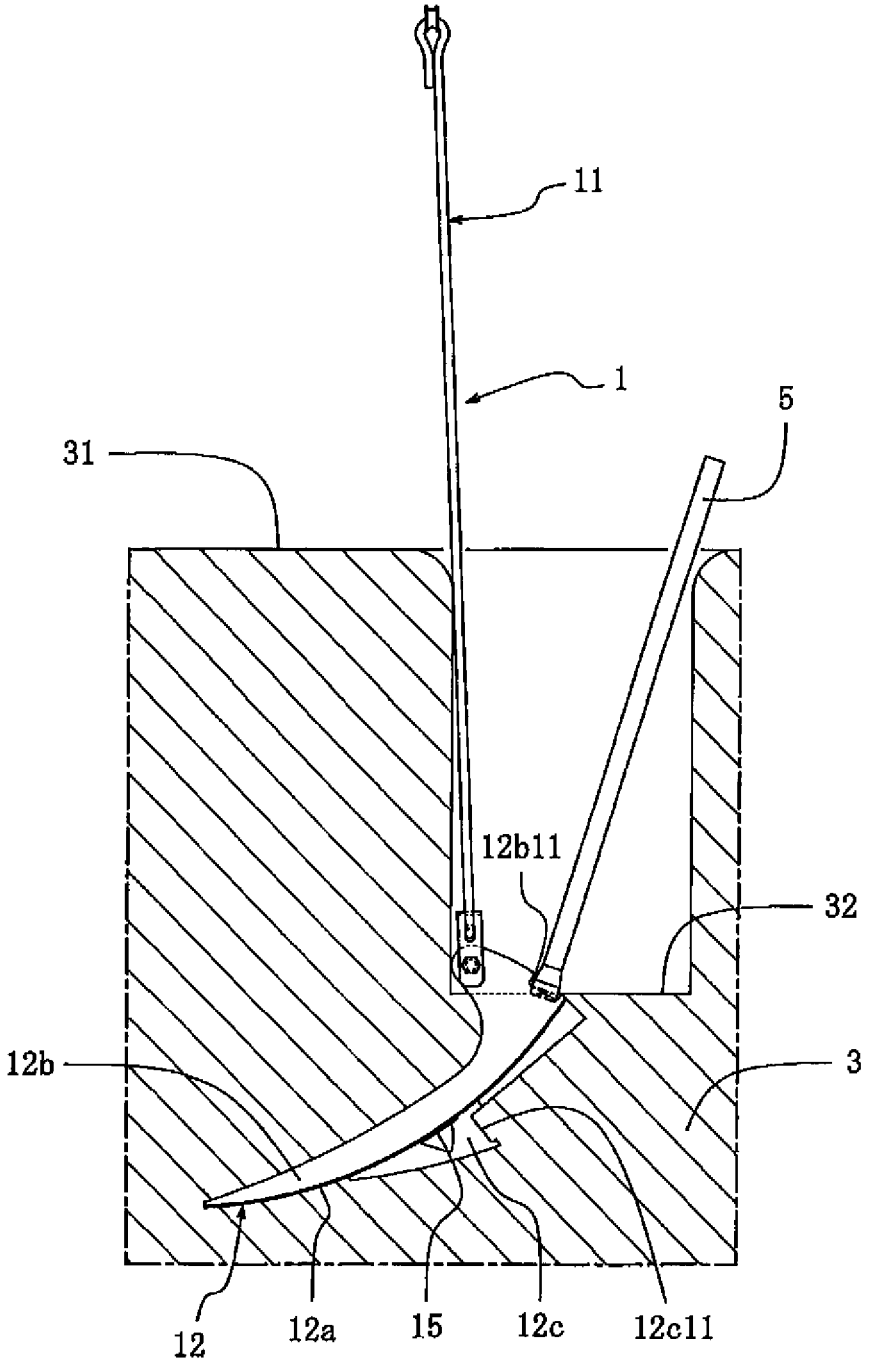
FIG. 9 is an explanatory drawing illustrating a fourth stage (a stage after being implanted into the soil by hitting the second hitting portion) of a method of usage of the support wire implanting anchor according to the embodiment of the invention.

Then, as illustrated in FIG. 8, unlike the first hitting portion 12*c*11 provided on the upper end portion of the first outer reinforcing plate portion 12*c*1, since the second hitting portion 12*b*11 provided on the upper end portion of the inner reinforcing plate 12*b* (upper end portion) does not have any obstacle that impairs hitting by the implanting tool 5, the anchor body portion 12 of the support wire implanting anchor 1 can be implanted into the ground 3 as illustrated in FIG. 9 by hitting the second hitting portion 12*b*11 by the distal end portion of the implanting tool 5.

Figure 10:
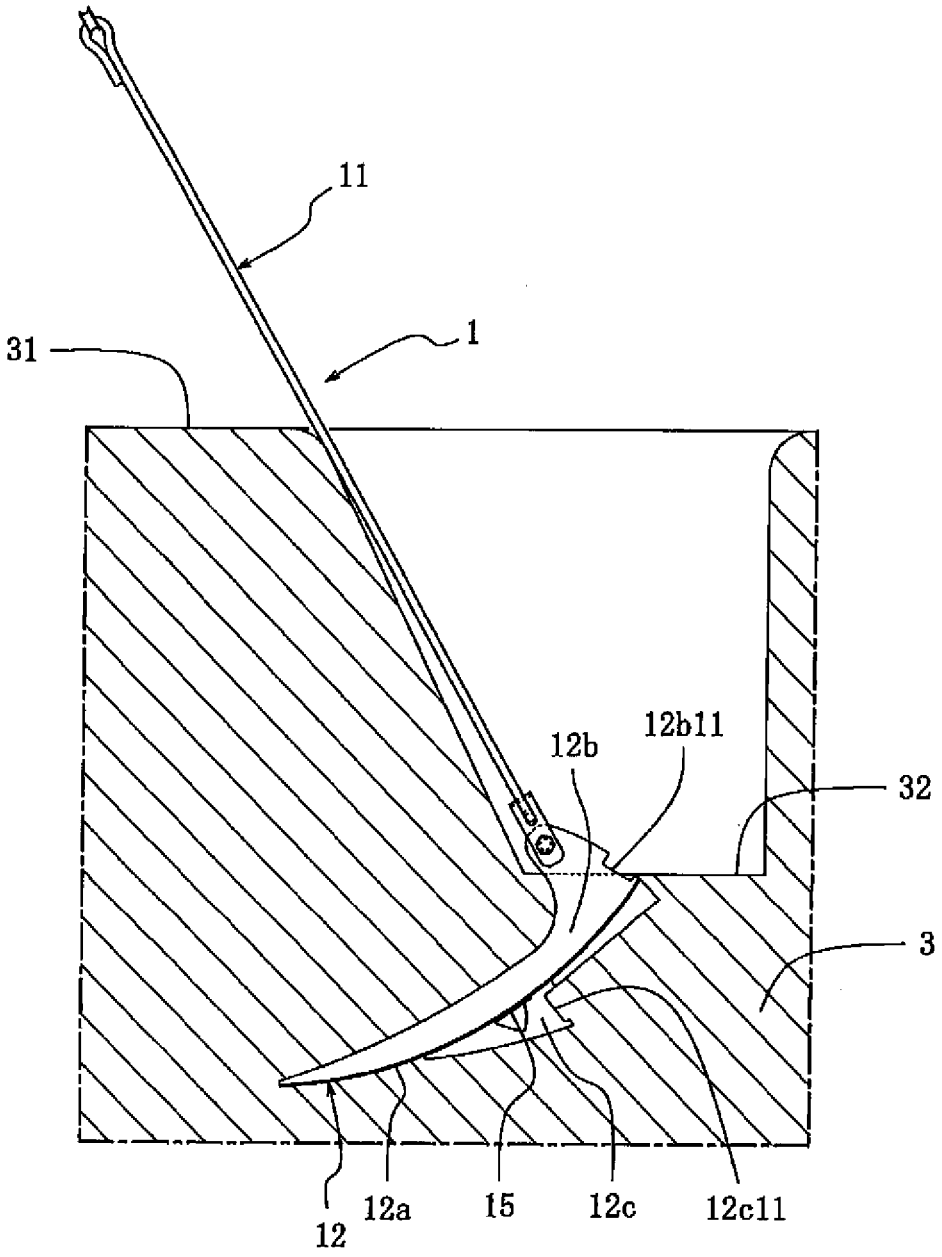
FIG. 10 is an explanatory drawing illustrating a fifth stage (a stage in which the ground on an aboveground upright member side of the embedding hole is cut) of a method of usage of the support wire implanting anchor according to the embodiment of the invention.

In the case where the support wire implanting anchor 1 and the aboveground upright member 2 are coupled with the support wire 4 as illustrated in FIG. 1 and the aboveground upright member 2 is supported, the rod portion 11 of the support wire implanting anchor 1 needs to be inclined toward the aboveground upright member 2, and hence portion of the embedding hole 32 with which the rod portion 11 abuts is grooved so that the rod portion 11 can be inclined obliquely as illustrated in FIG. 10. Subsequently, the embedding hole 32 is filled to complete.

Therefore, according to the support wire implanting anchor 1 of the embodiment, the first hitting portion 12*c*11 is provided on the outer reinforcing plate 12*c* and the second hitting portion 12*b*11 which is to be hit next to the first hitting portion 12*c*11 is provided at a position higher than the first hitting portion 12*c*11. Therefore, even in the case where the cutting surface area of the embedding hole 32 is small or when the curvature of the anchor body portion 12 is large, the anchor body portion 12 may be implanted at an acute angle into the ground surface 31 more easily and reliably than those of the related art.

In particular, in the support wire implanting anchor 1 of the embodiment, the second hitting portion 12*b*11 is provided on the base portion 12*b*1, which is the upper end portion of the inner reinforcing plate 12*b*, which is a position higher than the first hitting portion 12*c*11. Therefore, even though the inner diameter of the embedding hole 32 is small, the anchor body portion 12 may be implanted at an acute angle into the ground surface 31 by hitting the first hitting portion 12*c*11 of the first outer reinforcing plate portion 12*c*1 by the implanting tool 5 and then hitting the second hitting portion 12*b*11 of the inner reinforcing plate 12*b*.

Consequently, the curvature of the resistance plate body 12*a* of the anchor body portion 12 can be increased to allow the implanting further at an acute angle with respect to the ground surface 31, and hence a further sufficient resistance force (tension-resistance force) may be obtained.

With the support wire implanting anchor 1 of the embodiment, the movable resisting plate 15 closes in proximity to the anchor body portion 12 at the time of implanting into the ground 3 and the movable resisting plate 15 opens by the resistance applied from earth and sand in the ground 3 when embedded in the ground 3 and pulled in the direction pulled out from the ground 3, implanting of the stabilizing plate in addition to the resistance plate is not necessary in the anchor body portion 12, and hence a higher tension-resistance force is achieved while improving the workability.

In the description of the embodiment described above, the fan-shaped opening portion 12*c*12 of a fan shape is provided on the first outer reinforcing plate portion 12*c*1 of the outer reinforcing plate 12*c*, and the movable resisting plate 15 is mounted on the fan-shaped opening portion 12*c*12. However, the invention is not limited thereto, and the movable resisting plate 15 and the fan-shaped opening portion 12*c*12 may be omitted although at the expense of being easily coming away.

In the description of the above-described embodiment, the movable resisting plate 15 is rotatably provided on the fan-shaped opening portion 12*c*12 formed on the first outer reinforcing plate portion 12*c*1 of the outer reinforcing plate 12*c*. However, the invention is not limited thereto, and the second outer reinforcing plate portion 12*c*2 may be provided with the fan-shaped opening portion and in the same manner, the movable resisting plate 15 may be rotatably provided on the fan-shaped opening portion, may be rotatably provided on the outer reinforcing plate 12*c* with a rotation pin or the like without providing the fan-shaped opening portion 12*c*12 or may be provided on the inner reinforcing plate 12*b* instead of the outer reinforcing plate 12*c*. In addition, a configuration in which the movable resisting plate 15 as described above may be mounted via an opening, a pin, and a rotation shaft so as to open and close with respect to the outer reinforcing plate 12*c* or the inner reinforcing plate 12*b* instead of opening and closing with respect to the resistance plate body 12*a* is also applicable as a matter of course.

In the description of the embodiment described above, the first hitting portion 12*c*11 is provided at an upper end portion of the first outer reinforcing plate portion 12*c*1 and the second hitting portion 12*b*11 is provided on the base portion 12*b*1 of the inner reinforcing plate 12*b*. However, the invention is not limited thereto and, for example, the second hitting portion 12*b*11 may be provided on the second outer reinforcing plate portion 12*c*2 or the upper end portion of the anchor body portion 12. In other words, in the invention, the first hitting portion 12*c*11 only needs to be provided on the outer reinforcing plate 12*c*, and the second hitting portion 12*b*11 to be hit next to the first hitting portion 12*c*11 only needs to be provided at a position higher than the first hitting portion 12*c*11, whereby the number of hitting portions is not limited to two including the first hitting portion and the second hitting portion, and three or more hitting portions may be provided.

What is claimed is:

1. A support wire implanting anchor configured to be implanted by an implanting tool in the case of coupling an aboveground upright member and the ground with a support wire and embedded under the soil in order to prevent the aboveground upright member such as a power pole from falling down, comprising:

a rod portion and an anchor body portion, wherein the rod portion includes:

an upper coupling portion coupled to the support wire; and a lower coupling portion coupled to the anchor body portion, the anchor body portion includes:

a resistance plate body curved so as to protrude toward the outside;

an inner reinforcing plate provided so as to extend upright from an inner side of the resistance plate body and supported rotatably at the other end portion of the rod portion; and an outer reinforcing plate provided so as to extend upright from an outside of the resistance plate body, a first hitting portion hit by the implanting tool firstly is provided on the outer reinforcing plate, and a second hitting portion hit by the implanting tool next to the first hitting portion is provided on the inner reinforcing plate, the outer reinforcing plate and/or the resistance plate body at a position higher than the first hitting portion.

2. The support wire implanting anchor according to claim 1, wherein the second hitting portion is provided at an upper end portion of the inner reinforcing plate, an upper end portion of the outer reinforcing plate and/or an upper end portion of the resistance plate body.

3. The support wire implanting anchor according to claim 1, wherein the anchor body portion includes a movable resisting plate configured to be in a closed state in proximity to the anchor body portion when being implanted into the soil, and opened by a resistance applied from earth and sand in the soil in the case of being embedded under the soil and pulled in a direction pulled out from under the soil.

4. The support wire implanting anchor according to claim 3, wherein the outer reinforcing plate of the anchor body portion is provided with a fan-shaped opening portion having a center at a joint portion between an outer surface of the resistance plate body and the outer reinforcing plate and having a fan shape with an arc on an upper side, and the movable resisting plate is provided with a slit at the center thereof, is movably fitted to the fan-shaped opening portion with the slit loosely fitting on the outer reinforcing plate when being mounted in the fan-shaped opening portion, and is configured to close in proximity to the anchor body portion when being implanted into the soil, and open by a resistance applied from earth and sand in the soil when being embedded and pulled in a direction pulled out from under the soil.

5. The support wire implanting anchor according to claim 2, wherein the anchor body portion includes a movable resisting plate configured to be in a closed state in proximity to the anchor body portion when being implanted into the soil, and opened by a resistance applied from earth and sand in the soil in the case of being embedded under the soil and pulled in a direction pulled out from under the soil.

6. The support wire implanting anchor according to claim 5, wherein the outer reinforcing plate of the anchor body portion is provided with a fan-shaped opening portion having a center at a joint portion between an outer surface of the resistance plate body and the outer reinforcing plate and having a fan shape with an arc on an upper side, and the movable resisting plate is provided with a slit at the center thereof, is movably fitted to the fan-shaped opening portion with the slit loosely fitting on the outer reinforcing plate when being mounted in the fan-shaped opening portion, and is configured to close in proximity to the anchor body portion when being implanted into the soil, and open by a resistance applied from earth and sand in the soil when being embedded and pulled in a direction pulled out from under the soil.

* * * * *